US005529867A

United States Patent [19]

Terrell et al.

[11] Patent Number: 5,529,867

[45] Date of Patent: Jun. 25, 1996

[54] PHOTOCONDUCTIVE RECORDING MATERIAL WITH CROSSLINKED BINDER SYSTEM

[75] Inventors: David Terrell, Lint; Stefaan De Meutter, Antwerp; Marcel Monbaliu, Mortsel, all of Belgium

[73] Assignee: Agfa-Gevaert, N.V., Mortsel, Belgium

[21] Appl. No.: 335,712

[22] PCT Filed: May 4, 1993

[86] PCT No.: PCT/EP93/01100

§ 371 Date: Feb. 13, 1995

§ 102(e) Date: Feb. 13, 1995

[87] PCT Pub. No.: WO93/24861

PCT Pub. Date: Dec. 9, 1993

[30] Foreign Application Priority Data

Jun. 4, 1992 [EP] European Pat. Off. ..... 92201610

[51] Int. Cl.[6] ..... G03G 5/04

[52] U.S. Cl. ..... 430/58; 430/69

[58] Field of Search ..... 430/58, 59, 69

[56] References Cited

U.S. PATENT DOCUMENTS 3,025,160 3/1962 Bunge ..... 96/1

FOREIGN PATENT DOCUMENTS 1-94348 4/1989 Japan ..... 430/58

*Primary Examiner*—John Goodrow

*Attorney, Agent, or Firm*—Breiner & Breiner

[57] ABSTRACT

A photoconductive recording material containing a support and a charge generating layer (CGL) in contiguous relationship with a charge transporting layer (CTL) containing a n-charge transporting material (n-CTM), wherein the binder of said charge generating layer (CGL) is made insoluble in methylene chloride by crosslinking, and said binder is composed essentially of at least one resin (1) and/or (2) crosslinked with at least one polyisocyanate, said resin (1) before its crosslinking corresponding with general formula (I) as defined in the description, and said resin (2) being a dialkanolamine-modified epoxy resin.

10 Claims, No Drawings

PHOTOCONDUCTIVE RECORDING MATERIAL WITH CROSSLINKED BINDER SYSTEM

FIELD OF THE INVENTION

The present invention relates to photosensitive recording materials suitable for use in electrophotography.

BACKGROUND OF THE INVENTION

In electrophotography photoconductive materials are used to form a latent electrostatic charge image that is developable with finely divided colouring material, called toner.

The developed image can then be permanently affixed to the photoconductive recording material, e.g. a photoconductive zinc oxide-binder layer, or transferred from the photoconductor layer, e.g. a selenium or selenium alloy layer, onto a receptor material, e.g. plain paper and fixed thereon. In electrophotographic copying and printing systems with toner transfer to a receptor material the photoconductive recording material is reusable. In order to permit rapid multiple printing or copying, a photoconductor layer has to be used that rapidly loses its charge on photo-exposure and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection of commercially useful photoconductive materials, since the fatigue of the photoconductive layer limits the copying rates achievable.

A further important property which determines the suitability of a particular photoconductive material for electrophotographic copying is its photosensitivity, which must be sufficiently high for use in copying apparatuses operating with the fairly low intensity light reflected from the original. Commercial usefulness also requires that the photoconductive layer has a spectral sensitivity that matches the spectral intensity distribution of the light source e.g. a laser or a lamp. This enables, in the case of a white light source, all the colours to be reproduced in balance.

Known photoconductive recording materials exist in different configurations with one or more "active" layers coated on a conducting substrate and include optionally an outermost protective layer. By "active" layer is meant a layer that plays a role in the formation of the electrostatic charge image. Such a layer may be the layer responsible for charge carrier generation, charge carrier transport or both. Such layers may have a homogeneous structure or heterogeneous structure.

Examples of active layers in said photoconductive recording material having a homogeneous structure are layers made of vacuum-deposited photoconductive selenium, doped silicon, selenium alloys and homogeneous photoconducting polymer coatings, e.g. of poly(N-vinylcarbazole) or polymeric binder(s) molecularly doped with an electron (negative charge carrier) transporting compound or a hole (positive charge carrier) transporting compound such as particular hydrazones, amines and heteroaromatic compounds sensitized by a dissolved dye, so that in said layers both charge carrier generation and charge carrier transport take place.

Examples of active layers in said photoconductive recording material having a heterogeneous structure are layers of one or more photosensitive organic or inorganic charge generating pigment particles dispersed in a polymer binder or polymer binder mixture in the presence optionally of (a) molecularly dispersed charge transport compound(s), so that the recording layer may exhibit only charge carrier generation properties or both charge carrier generation and charge transport properties.

According to an embodiment that may offer photoconductive recording materials with particularly low fatigue a charge generating and charge transporting layers are combined in contiguous relationship. Layers which serve only for the charge transport of charge generated in an adjacent charge generating layer are e.g. plasma-deposited inorganic layers, photoconducting polymer layers, e.g. on the basis of poly(N-vinylcarbazole) or layers made of low molecular weight organic charge transporting compounds molecularly distributed in a polymer binder or binder mixture.

Useful charge carrier generating pigment materials (CGM's) belong to one of the following classes:

a) perylimides, e.g.C.I. 71130 (C.I.=Colour Index) described in DBP 2 237 539;
b) polynuclear quinones, e.g. anthanthrones such as C.I. 59 300 described in DBP 2 237 678;
c) quinacridones, e.g. C.I. 46 500 described in DBP 2 237 679;
d) naphthalene 1,4,5,8-tetracarboxylic acid derived pigments including the perinones, e.g. Orange GR, C.I. 71 105 described in DBP 2 239 923;
e) tetrabenzoporphyrins and tetranaphthaloporphyrins, e.g. $H_2$-phthalocyanine in X-crystal form (X-$H_2$Pc) described in U.S. Pat. No. 3,357,989, metal phthalocyanines, e.g. CuPc C.I. 74 160 described in DBP 2 239 924, indium phthalocyanine described in U.S. Pat. No. 4,713,312 and tetrabenzoporphyrins described in EP 428.214A; and naphthalocyanines having siloxy groups bonded to the central metal silicon described in published EPA 243,205;
f) indigo- and thioindigo dyes, e.g. Pigment Red 88, C.I. 73 312 described in DBP 2 237 680;
g) benzothioxanthene derivatives as described e.g. in Deutsches Auslegungsschrift (DAS) 2 355 075;
h) perylene 3,4,9,10-tetracarboxylic acid derived pigments including condensation products with o-diamines as described e.g. in DAS 2 314 051;
i) polyazo-pigments including bisazo-, trisazo- and tetrakisazo-pigments, e.g. Chlordiane Blue C.I. 21 180 described in DAS 2 635 887, trisazo-pigments, e.g. as described in U.S. Pat. No. 4,990,421 and bisazo-pigments described in Deutsches Offenlegungsschrift (DOS) 2 919 791, DOS 3 026 653 and DOS 3 032 117;
j) squarylium dyes as described e.g. in DAS 2 401 220;
k) polymethine dyes;
l) dyes containing quinazoline groups, e.g. as described in GB-P 1,416,602 according to the following general formula:

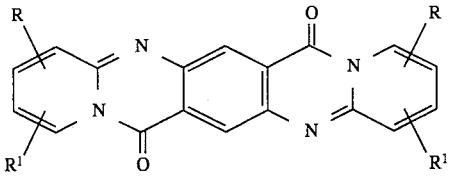

in which R and $R^1$ are either identical or different and denote hydrogen, $C_1$–$C_4$ alkyl, alkoxy, halogen, nitro or hydroxyl or together denote a fuxed aromatic ring system;

m) triarylmethane dyes; and n) dyes containing 1,5-diamino-anthraquinone groups, o) inorganic photoconducting pigments e.g. Se, Se alloys, $As_2Se_3$, $TiO_2$, ZnO, CdS, etc.

Organic charge carrier transporting substances may be either polymeric or non-polymeric materials.

Preferred non-polymeric materials for negative charge transport are:

a) dicyanomethylene and cyano-alkoxycarbonylmethylene condensates with aromatic ketones such as 9-dicyanomethylene-2,4,7-trinitrofluorenone (DTF); 1-dicyanomethylene-indan-1-ones as described in published EP application 537808 according to the general formula:

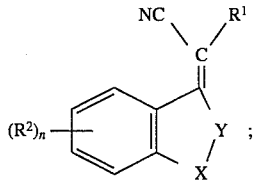

wherein: $R^1$, $R^2$, X and Y are as defined in said EP application. or compounds according to the following general formula:

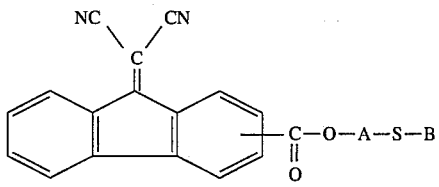

wherein: A is a spacer linkage selected from the group consisting of an alkylene group including a substituted alkylene group, a bivalent aromatic group including a substituted bivalent aromatic group; S is sulfur, and B is selected from the group, consisting of an alkyl group including a substituted alkyl group,, and an aryl group including a substituted aryl group as disclosed in U.S. Pat. No. 4,546,059;

and 4-dicyanomethylene 1,1-dioxo-thiopyran-4-one derivatives as disclosed in U.S. Pat. No. 4,514,481 and U.S. Pat. No. 4,968,813, e.g.

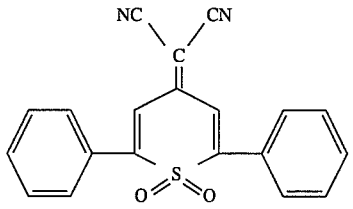

and

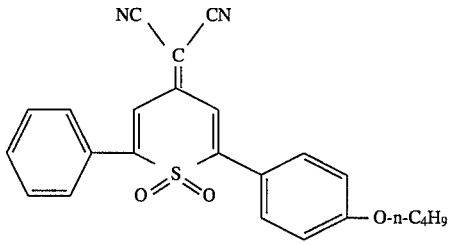

b) derivatives of malononitrile dimers as described in published EP application 534004;

c) nitrated fluorenones such as 2,4,7-trinitrofluorenone and 2,4,5,7-tetranitrofluorenone;

d) substituted 9-dicyano methylene fluorene compounds as disclosed in U.S. Pat. No. 4,562,132;

e) 1,1,2-tricyanoethylene derivatives.

The choice of binder for the charge generating layer (CGL) for a given charge generating pigment material (CGM) and a charge transport layer (CTL) containing a given charge transport material (CGM) has a strong influence on the electro-optical properties of the photoreceptors. One or more of the following phenomena can have a negative influence on the electro-optical properties of the photoconductive recording material:

l) interfacial mixing between the CGL and the CTL resulting in CGM-doping of the CTL and CTM-doping of the CGL causing charge trapping;

ii) charge trapping in the CGL;

iii) poor charge transport in the CGL;

iv) poor charge transport blocking properties in the absence of a blocking layer.

Interfacial mixing between the CGL and the CTL can be avoided by using a CGL-binder or binders, which is/are insoluble in the solvent used for dissolving the CTL-binders in which CTM's exhibit optimum charge transport properties.

The range of solvents in which both CTL-binders and CTM's are soluble is extremely narrow and often limited to chlorohydrocarbons such as methylene chloride. Methylene chloride is an extremely powerful solvent and the range of CGL-binders which is totally insoluble in methylene chloride is extremely limited, unless the CGL-binder is insolubilized (by crosslinking of polymer chains) in a subsequent hardening process.

Hardening is considered here as a treatment which renders the binder of a charge generating layer of the photoconductive recording material insoluble in methylene chloride.

SUMMARY OF THE INVENTION

It is an object of the present invention to provide a multiple layer photoconductive recording material with improved photosensitivity.

It is a further object of the present invention to provide a photoconductive recording material wherein interfacial mixing of a charge transporting layer with a charge generating layer is avoided during overcoating of the charge generating layer with a solution of the charge transporting layer composition.

It is still a further object of the present invention to provide a said photoconductive recording material wherein the binder system for the charge generating layer allows efficient charge transport in the charge generating layer and efficient charge injection into the charge transporting layer which is a negative charge transporting layer.

In accordance with the present invention a photoconductive recording material is provided containing a support and a charge generating layer (CGL) in contiguous relationship (contact) with a charge transporting layer (CTL) containing a n-charge transporting material (n-CTM), wherein the binder of said charge generating layer (CGL) is made insoluble in methylene chloride by crosslinking, and said binder is composed essentially of at least one resin (1) and/or (2) crosslinked with at least one aliphatic polyisocyanate, said resin (1) before its crosslinking corresponding with the following general formula (I):

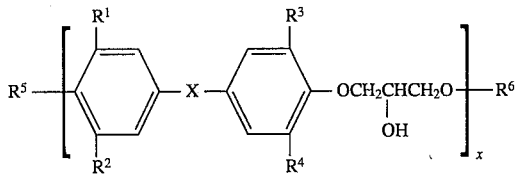

(I)

in which: X represents S, $SO_2$,

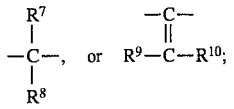

each of $R^1$, $R^2$, $R^3$, $R^4$, $R^9$ and $R^{10}$ (same or different) represents hydrogen, halogen, an alkyl group or an aryl group; where $R^5$=OH,

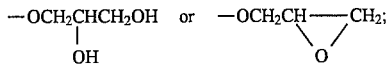

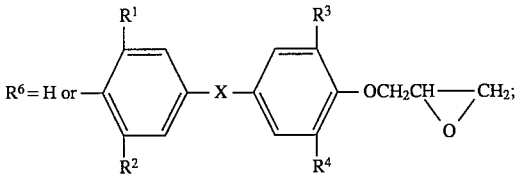

each of $R^7$ and $R^8$ (same or different) represents hydrogen, an alkyl group, an aryl group or together represent the necessary atoms to close a cycloaliphatic ring, e.g. a cyclohexane ring; and $x \geqq 4$; and said resin (2) before its crosslinking being a dialkanolamine-modified epoxy resin.

The polyisocyanate used in the crosslinking reaction may be set free e.g. by heat, in situ in the recording layer from a blocked aliphatic polyisocyanate.

DETAILED DESCRIPTION OF THE INVENTION

According to a preferred embodiment the photoconductive recording material according to the present invention has a charge generating layer (CGL) containing as the sole binder one or more resins obtained by the hardening (crosslinking) of polymeric compounds according to the general formula (I) and/or dialkanolamine-modified epoxy-resins with one or more polyisocyanates.

According to still another preferred embodiment a photoconductive recording material according to the present invention has a charge generating layer containing one or more resins obtained by the hardening (crosslinking) of at least one polymeric compound according to said general formula (I) and/or of at least one dialkanolamine-modified epoxy resin having a total amount of free HO-groups in an equivalent ratio range from 1.8:1 to 1:1.8 with respect to free isocyanate groups of said polyisocyanate(s).

According to a further preferred embodiment a photoconductive recording material according to the present invention has a charge generating layer containing (i) one or more resins obtained by the hardening (crosslinking) of polymeric compounds according to the general formula (I) and/or dialkanolamine-modified epoxy resins with one or more polyisocyanates and (ii) at least 30 wt % of charge generating compound(s).

Particularly suitable polyisocyanates used for hardening resins (1) and (2) as defined above are: 1,6-hexane diisocyanate (HDI) and toluylene diisocyanate (TDI), 1,4-cyclohexane diisocyanate and 4,4' -diisocyanate-dicyclohexylmethane and blocked isocyanate derivatives thereof.

The hardening reaction taking place preferably at elevated temperature is mainly based on the reaction between the isocyanate groups or the thermo-generated isocyanate groups and the free hydroxyl groups of the resins (1) and/or (2), but is also based on the formation of allophanate groups in a reaction of already formed urethane groups in said resin with isocyanate groups of the polyisocyanate [D. H. Solomon "The Chemistry of Organic Film Formers"—John Wiley & Sons, Inc. New York, (1967) p. 203].

Bayer AG—Germany produces a large variety of polyisocyanates and blocked polyisocyanates under the tradename DESMODUR, such as:

DESMODUR N75, a 75% solution of a biuret HDI;

DESMODUR N100, a biuret HDI;

DESMODUR N3200, a biuret HDI with a lower viscosity than

DESMODUR N100;

DESMODUR N300, an HDI isocyanurate; and

DESMODUR N3390, a 90% solution of an HDI isocyanurate;

DESMODUR L75, a 75% solution of the TDI-adduct;

DESMODUR IL, a TDI-isocyanurate;

DESMODUR IL 1351, a TDI-isocyanurate; and

DESMODUR HL, a TDI/HDI-polyisocyanate.

and blocked polyisocyanates (polyisocyanate precursors) such as:

DESMODUR BL 3175, a blocked HDI-type crosslinking stoving urethane resin; and

DESMODUR BL 100, a blocked TDI-type crosslinking stoving urethane resin;

The synthesis of resins (1) proceeds by using a bisphenol and epichlorhydrin as starting materials as described e.g. in "The Chemistry of Organic Film Formers" by D. H. Solomon, John Wiley & Sons, Inc. New York (1967), the chapter "Epoxy Resins", p. 179–189).

Preferred bisphenol-epichlorhydrin resin derivatives are prepared from bisphenol A (4,4'-isopropylidenediphenol) and epichlorhydrin.

Suitable commercially available resins according to general formula (I) are phenoxy resins from Union Carbide sold under the tradename PHENOXY, e.g. PHENOXY PKHC, PHENOXY PKHH, PENOH PKHJ and PHENOXY PKHM-301 and high molecular weight epichlorhydrin epoxy resins such as EPONOL Resin 53-BH-35 and EPONOL Resin 55-BH-30 (tradenames of Shell Chemical. Co., DER 684-EK40 (tradename from Dow chemical) and ARALDITE GZ488 N40 (tradename from Ciba-Geigy AG).

Dialkanolamine-modified epoxy resins can be prepared from commercially available epoxy resins by reaction with dialkanolamines in the melt or in a solvent mixture under reflux (see the above mentioned book of D. H. Solomon, p. 189–191).

(A) In the melt reaction the epoxy resin is heated to its melting point in a vessel equipped with a stirrer and a thermometer and the equivalent amount of dialkanolamine quickly added with stirring. The mixture is further heated at temperatures between 100° C. and 200° C., depending on the chain length of the epoxy resin, for two hours with inert gas being bubbled through the reaction mixture. After 2 hours the product is poured out of the vessel, allowed to cool and then broken up into small particles. The reaction is exothermic and cooling may be necessary to avoid local overheating.

(B) In the reaction in a solvent mixture a 50 wt % solution of epoxy resin in a mixture of ethylglycolacetate, methylisobutylketone and xylene (2:1:1) is added to a vessel equipped with a condenser, a thermometer and a stirrer. The equivalent mount of alkanolamine is then added with stirring and the reaction mixture heated to its boiling point. After 2 hours under reflux, the reaction mixture is cooled and a 50 wt % solution of the dialkanolamine-modified epoxy resin obtained.

The resins obtained by crosslinking the resins according to said general formula (I) and dialkanolamine-modified epoxy resins with aliphatic polyisocyanates may be used in combination with at least one other polymer serving as binding agent, e.g. in combination with acrylate and methacrylate resins, copolyesters of a diol, e.g. glycol, with isophthalic and/or terephthalic acid, polyacetals, polyurethanes, polyester-urethanes, aromatic polycarbonates.

Useful resin combinations contain at least 50% by weight of said resins hardened with said aliphatic polyisocyanates in the total binder content.

A polyester resin particularly suited for use in combination with said hardened resins is a polyester sold under the tradename DYNAPOL L 206 (DYNAPOL is a registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence of the charge generating layer to aluminium that may form a conductive coating on the support of the recording material.

Aromatic polycarbonates that are suitable for use in admixture with said resins (1) and/or (2) hardened with polyisocyanates are aromatic polycarbonates that can be prepared by methods such as those described by D. Freitag, U. Grigo, P. R. Müller and W. Nouvertné in the Encyclopedia of Polymer Science and Engineering, 2nd ed., Vol. II, pages 648–718, (1988) published by Wiley and Sons Inc., and have one or more repeating units within the scope of following general formula:

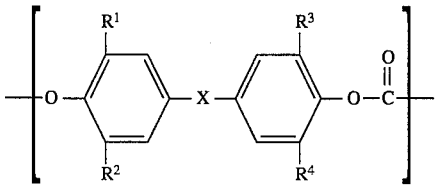

wherein: X, $R^1$, $R^2$, $R^3$ and $R^4$ have the same meaning as described in general formula (I) above.

Aromatic polycarbonates having a molecular weight in the range of 10,000 to 200,000 are preferred. Suitable polycarbonates having such a high molecular weight are .sold under the registered trade mark MAKROLON of Bayer AG, W-Germany.

MAKROLON CD 2000 (registered trade mark) is a bisphenol A polycarbonate with molecular weight in the range of 12,000 to 25,000 wherein $R^1$=$R^2$=$R^3$=$R^4$=H, X is

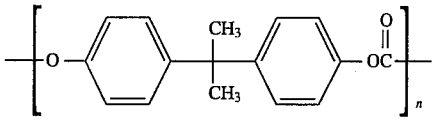

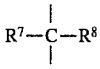

with $R^7$=$R^8$=CH3.

MAKROLON 5700 (registered trade mark) is a bisphenol A polycarbonate with molecular weight in the range of 50,000 to 120,000 wherein $R^1$=$R^2$=$R^3$=$R^4$=H, X is

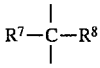

with $R^7$=$R^8$=CH3.

Bisphenol Z polycarbonate is an aromatic polycarbonate containing recurring units wherein $R^1$=$R^2$=$R^3$=$R^4$=H, X is

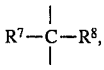

and R7 together with $R^8$ represents the necessary atoms to close a cyclohexane ring.

Suitable electronically inactive binder resins for use in unhardened active layers of the present photoconductive recording material are cellulose esters, acrylate and methacrylate resins, e.g. cyanoacrylate resins, polyvinyl chloride, and copolymers of vinyl chloride, e.g. copolyvinyl chloride/acetate and copolyvinyl chloride/maleic anhydride, polyester resins e.g. copolyesters of isophthalic acid and terephthalic acid with glycol and aromatic polycarbonate resins.

Further useful unhardened binder resins for an active layer are silicone resins, polystyrene and copolymers of styrene and maleic anhydride and copolymers of butadiene and styrene.

A charge transport layer in the photoconductive recording materials of the present invention preferably has a thickness in the range of 5 to 50 μm, more preferably in range of 5 to 30 μm. If such a layer contains low molecular weight charge transport molecules, such compounds will preferably be present in concentrations of 30 to 70% by weight.

Preferred binders for the negative charge transporting layer in the recording material of the present invention are homo- or co-polycarbonates with the general formula:

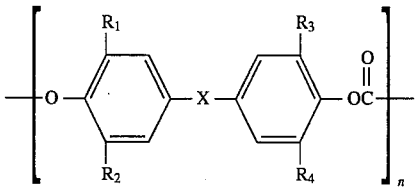

wherein: X, $R_1$, $R_2$, $R_3$ and $R_4$ have the same meaning as described in general formula (I) above. Specific polycarbonates useful as CTL-binders in the present invention are B1 to B7.

B1

-continued

B2

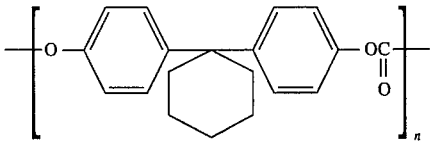

B3

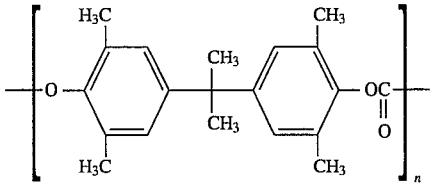

B4

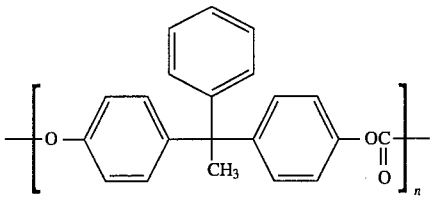

B5

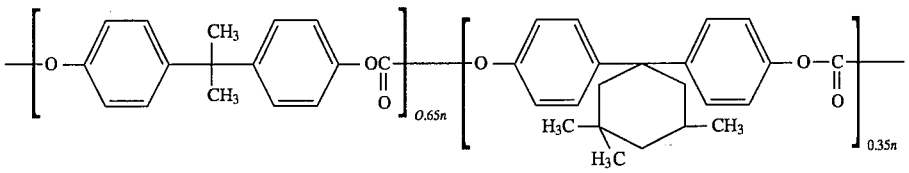

B6

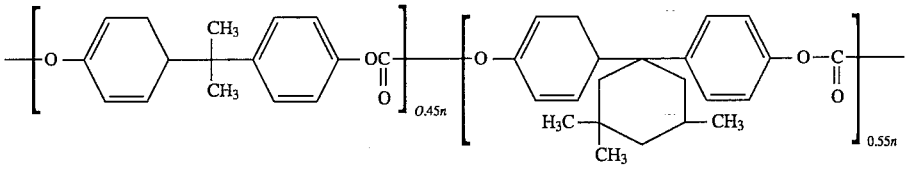

B7

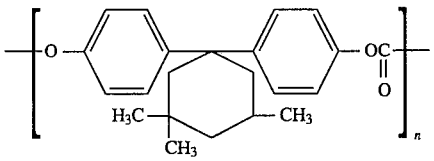

The presence of one or more spectral sensitizing agents can have an advantageous effect on the charge transport. In that connection reference is made to the methine dyes and xanthene dyes described in U.S. Pat. No. 3,832,171. Preferably these dyes are used in an amount not substantially reducing the transparency in the visible light region (420–750 nm) of the charge transporting layer so that the underlying charge generating layer still can receive a substantial amount of the exposure light when exposed through the charge transporting layer.

The charge transporting layer may contain compounds substituted with electron-donor groups forming an intermolecular charge transfer complex, i.e. donor-acceptor complex wherein the hydrazone compound represents an electron donating compound. Useful compounds having electron-donating groups are hydrazones such as 4-N,N-diethylamino-benzaldehyde- 1,1-diphenylhydrazone (DEH), amines such as tris(p-tolylamine) (TTA) and N,N'-diphenyl-N,N'-bis(3-methyl-phenyl)-[1,1-biphenyl]-4,4'-diamine (TPD) etc. The optimum concentration range of said derivatives is such that the acceptor/donor weight ratio range is from 2.5:1 to 1,000:1.

Compounds acting as stabilising agents against deterioration by ultra-violet radiation, so-called UV-stabilizers, may also be incorporated in said charge transport layer. Examples of UV-stabilizers are benztriazoles.

For controlling the viscosity of the coating compositions and controlling their optical clarity silicone oils may be added to the charge transport layer.

While with the common single layer photoconductive systems an increase in photosensitivity is coupled with an increase in the dark current and fatigue such is not the case in the double layer arrangement wherein the functions of charge generation and charge transport are separated and a photosensitive charge generating layer is arranged in contiguous relationship to a charge transporting layer.

As charge generating compounds for use in a recording material according to the present invention any of the organic pigment dyes belonging to one of the following classes and able to transfer electrons to electron transporting materials may be used:

a) perylimides, e.g. C.I. 71 130 (C.I.=Colour Index) described in DBP 2,237,539, b) polynuclear quinones, e.g. anthanthrones such as C.I. 59 300 described in DBP 2,237,678, c) quinacridones, e.g. C.I. 46 500 described in DBP 2,237,679, d) naphthalene 1,4,5,8-tetracarboxylic acid derived pigments including the perinones, e.g. Orange GR, C.I. 71 105 described in DBP 2,239,923, e) tetrabenzoporphyrins and tetranaphthaloporphyrins, e.g. $H_2$-phthalocyanine in X-crystal form (X-$H_2$Pc) described in U.S. Pat. No. 3,357,989, metal phthatocyanines, e.g. CuPc C.I. 74 160 described in DBP 2,239,924, indium phthalocyanine described in U.S. Pat. No. 4,713,312, tetrabenzoporphyrins described in EP 428,214A, silicon naphthalocyanines having siloxy groups bonded to the central silicon as described in EP-A 0243205 and X- and β-crystal morphology $H_2Pc(CN)_x$, $H_2Pc$ $(CH_3)_x$ and $H_2PcCl_x$ pigments, f) indigo- and thioindigo dyes, e.g. Pigment Red 88, C.I. 73 312 described in DBP 2,237,680, g) benzothioxanthene-derivatives as described e.g. in DAS 2,355,075, h) perylene 3,4,9,10-tetracarboxylic acid derived pigments including condensation products with o-diamines as described e.g. in DAS 2,314,051, i) polyazo-pigments including bisazo-, trisazo- and tetrakisazo-pigments, e.g. Chlordiane Blue C.I. 21 180 described in DAS 2,635,887, and bisazopigments described in DOS 2,919,791, DOS 3,026,653 and DOS 3,032,117, j) squatilium dyes as described e.g. in DAS 2,401,220, k) polymethine dyes.

l) dyes containing quinazoline groups, e.g. as described in GB-P 1,416,602 according to the following general formula:

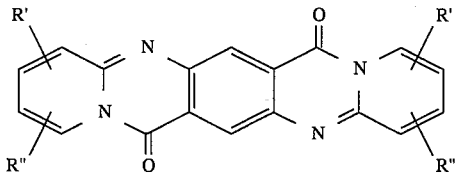

wherein R' and R" have the meaning described in GB-P 1,416,602.

Inorganic substances suited for photogenerating negative charges in a recording material according to the present invention are e.g. amorphous selenium and selenium alloys e.g. selenium-tellurium, selenium-tellurium-arsenic and selenium-arsenic and inorganic photoconductive crystalline compounds such as cadmium sulphoselenide, cadmiumselenide, cadmium sulphide and mixtures thereof as disclosed in U.S. Pat. No. 4,140,529.

The thickness of the charge generating layer is preferably not more than 10 μm, more preferably not more than 5 μm.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminum oxide layer acting as blocking layer preventing positive or negative charge injection from the support side. The thickness of said barrier layer is preferably not more than 1 micron.

The conductive support may be made of any suitable conductive material. Typical conductors include aluminium, steel, brass and paper and resin materials incorporating or coated with conductivity enhancing substances.

An insulating support such as a resin support is e.g. provided with a conductive coating, e.g. vacuum-deposited metal such as aluminium, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

The support may be in the form of a foil, web or be part of a drum.

An electrophotographic recording process according to the present invention comprises the steps of:

(1) overall electrostatically charging, e.g. with corona-device, the photoconductive layer containing as binder essentially at least one resin obtained by the' hardening (crosslinking) with one or more polyisocyanates of the above mentioned resins (1) and/or (2);

(2) image-wise photo-exposing said layer thereby obtaining a latent electrostatic image, that may be toner-developed.

When applying a "bilayer-system" electrophotographic recording material including on an electrically conductive support a photosensitive charge generating layer that contains as binder essentially at least one resin obtained by the crosslinking with one or more polyisocyanates of (a) compound(s) according to said general formula (I) and/or said dialkanolamine-modified epoxy resins, in contiguous relationship with a charge transporting layer, the photo-exposure of the charge generating layer proceeds preferably through the charge transporting layer but may be direct if the charge generating layer is uppermost or may proceed likewise through the conductive support if the latter is transparent enough to the exposure light.

The development of the latent electrostatic image commonly occurs preferably with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography"—The Focal Press—London, New York, enlarged and revised edition 1975, p. 50–51 and T. P. Maclean "Electronic Imaging" Academic Press—London, 1979, p. 231).

According to a particular embodiment electrostatic charging, e.g. by corona, .and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the charge generating layer may be used in combination with all kinds of photon-radiation, e.g. light of the visible spectrum, infra-red light, near ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof.

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The following examples further illustrate the present invention. All parts, ratios and percentages are by weight unless otherwise stated.

The evaluations of electrophotographic properties determined on the recording materials of the following examples relate to the performance of the recording materials in an electrophotographic process with a reusable photoreceptor. The measurements of the performance characteristics were carried out by using a sensitometric measurement in which the discharge was obtained for 16 different exposures including zero exposure. The photoconductive recording sheet material was mounted with its conductive backing on an aluminium drum which was earthed and rotated at a circumferential speed of 10 cm/s. The recording material was sequentially charged with a positive corona at a voltage of +5.7 kV operating with a grid voltage of + 600 V. Subsequently the recording material was exposed (simulating image-wise exposure) with a light dose of monochromatic light obtained from a monochromator positioned at the circumference of the drum at an angle of 45° with respect to the corona source. The photo-exposure lasted 200 ms. Thereupon, the exposed recording material passed an electrometer probe positioned at an angle of 180° with respect to the corona source. After effecting an overall post-exposure with a halogen lamp producing 355 mJ/m2 positioned at an angle of 270° with respect to the corona source a new copying cycle started. Each measurement relates to 80 copying cycles in which the photoconductor is exposed to the full light source intensity for the first 5 cycles, then sequentially to the light source the light output of which is moderated by grey filters of optical densities 0.2, 0.38, 0.55, 0.73, 0.92, 1.02, 1.20, 1.45, 1.56, 1.70, 1.95, 2.16, 2.25, 2.51 and 3.21 each for 5 cycles and finally to zero light intensity for the last 5 cycles.

The electro-optical results quoted in the EXAMPLES 1 to 31 hereinafter refer to charging level at zero light intensity (CL) and to discharge at a light intensity corresponding to the light source intensity moderated by a grey filter to the exposure indicated to a residual potential RP.

The % discharge is:

$$\frac{(CL-RP)}{CL} \times 100$$

For a given corona voltage, corona grid voltage, separating distance of the corona wires to recording surface and drum circumferential speed the charging level CL is only dependent upon the thickness of the charge transport layer and its specific resistivity. In practice CL expressed in volts should be preferably ≧30 d, where d is the thickness in μm of the charge transport layer.

Charge generating materials (CGM's) used in the following examples have the following formulae:

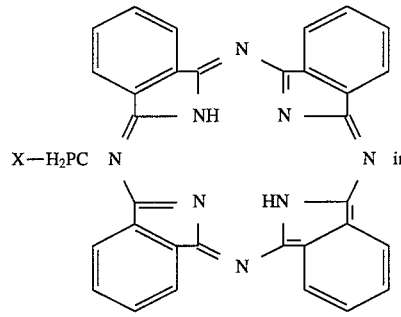

X-H Pc(CN)$_{0.36}$: a mixed crystalline pigment, 1.75:1 molar ratio of X-$H_2$Pc, and

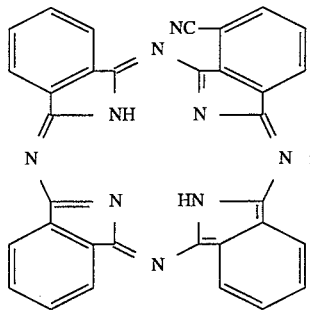

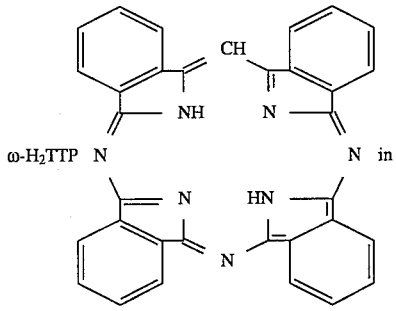

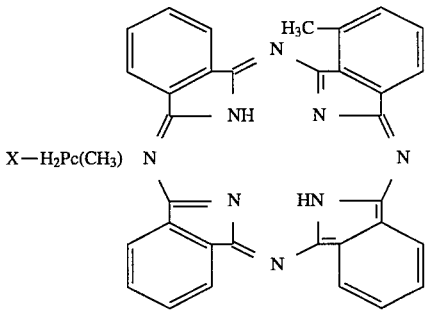

in X-morphology

X-$H_2$Pc(Cl)$_{0.67}$: a mixed crystalline pigment, 0.5:1 molar ratio of $H_2$Pc and

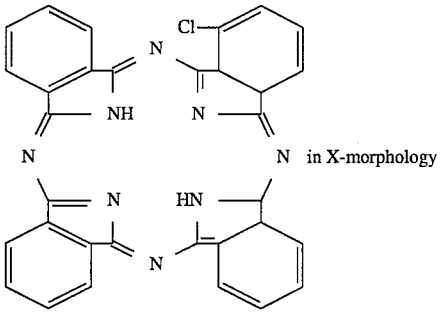
DBA:
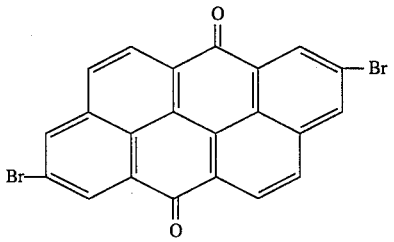
Perylene pigment:
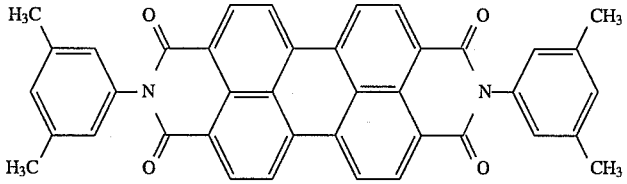
Negative charge transporting compounds (CTM), i.e. electron-transporting compounds, (N1 to N8) used in the following Examples are given hereinafter.
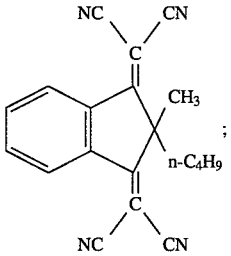
(N1)
;
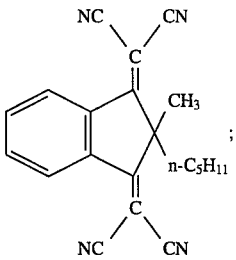
(N2)
;
-continued
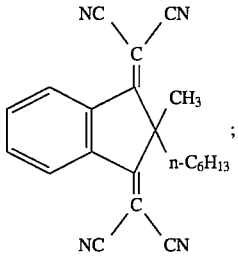
(N3)
;
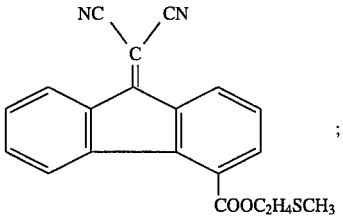
(N4)
;
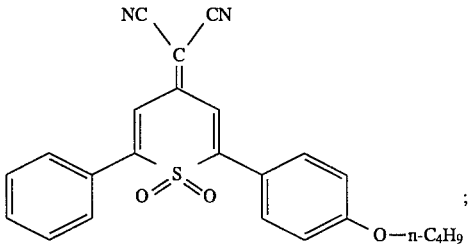
(N5)
;

-continued

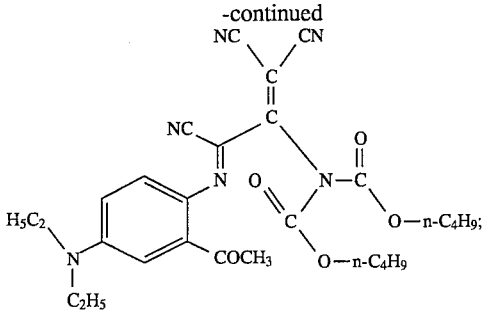

(N6)

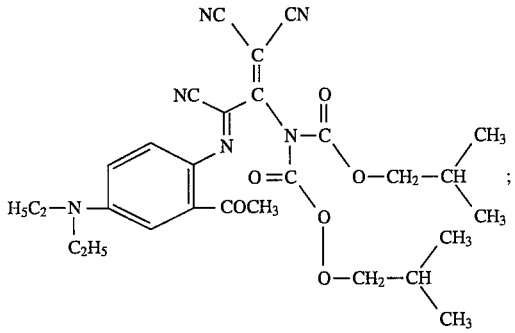

(N7)

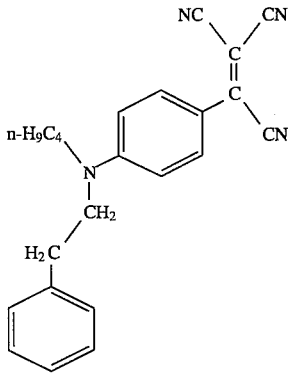

(N8)

EXAMPLE 1

In the production of a composite layer electrophotographic recording material a 175 μm thick polyester film pre-coated with a vacuum-deposited layer of aluminium was doctor-blade coated with a dispersion of charge generating pigment to a thickness of 0.9 μm.

Said dispersion was prepared by mixing 2 g of metal-free X-phthalocyanine (FASTOGEN Blue 8120B from Dainippon Ink and Chemical Inc.); 0.75 g of DER$^{684}$-EK40 (tradename for a 40% solution of a high molecular weight bisphenol A-epichlorhydrin epoxy resin in butan-2-one from Dow Chemical); 9.62 g of butan-2-one and 16.38 g of methylene chloride for 40 hours in a ball mill. 2.28 g of DER$^{684}$-EK 40 (tradename) 1.04 g of DESMODUR N75 (tradename for a 75% solution of a hexamethylene diisocyanate-type hardener in 1:1 xylene 1-methoxypropylacetate-2 from Bayer AG); 7.79 g of methylene chloride and 4.58 g of butan-2-one were then added to the dispersion and the dispersion mixed for a further 15 minutes.

The applied layer was dried and thermally hardened for 2 hours at 100° C. and then overcoated using a doctor-blade coater with a filtered solution of 1.5 g of the CTM N2; 1.83 g of MAKROLON 5700 (tradename for a bisphenol A-polycarbonate from Bayer AG); and 24.42 g of methylene chloride to a thickness of 13.1 μm after drying at 50° C. for 16 hours.

The electro-optical characteristics of the thus obtained photoconductive recording material was determined as described above. At a charging level (CL) of + 550 V and an exposure $I_{660}t$ of 20 mJ/m$^2$, the following results were obtained:

CL=+550 V

RP=+111 V

% discharge=79.8

EXAMPLES 2 TO 5

The photoconductive recording materials of examples 2 to 5, were produced as described for example 1 except that alternative polyisocyanate hardeners were used and the CGL of example 5 was hardened at 150° C. The amounts of DER684-EK40 (tradename) and polyisocyanate hardeners were adjusted to obtain a theoretical degree of hardening of 100%. The weight percentage of DER684-EK40 (tradename) and hardener in the CGL's calculated on the basis of the solids contents of the reactants are given in Table 1 together with the CTL layer thicknesses ($d_{CTL}$).

The electro-optical characteristics of the obtained photoconductive recording materials were determined as described above and the results summarized with those for the material of example 1 in Table 1.

TABLE 1

| Example No. | DER684-EK40 conc. [wt %] | Hardener (by tradename) | Hardener conc. [wt %] | $^d$CTL [μm] | $I_{660}t$ = 20 mJ/m$^2$ CL [V] | RP [V] | % discharge |
|---|---|---|---|---|---|---|---|
| 1 | 30.35 | DESMODUR N75* | 19.65 | 13.1 | +550 | +111 | 79.8 |
| 2 | 30.35 | DESMODUR N100* | 19.65 | 14.1 | +496 | +133 | 73.2 |
| 3 | 30.86 | DESMODUR N3200* | 19.14 | 15.1 | +507 | +120 | 76.3 |
| 4 | 30.1 | DESMODUR N3300* | 19.9 | 15.1 | +508 | +110 | 78.3 |
| 5 | 25.52 | DESMODUR BL3175* | 24.48 | 15.1 | +500 | +113 | 77.4 |
| 6 | 27.45 | DESMODUR L75* | 22.55 | 12.1 | +555 | +166 | 70.1 |

*from Bayer AG.

EXAMPLES 7 TO 9

The photoconductive recording materials of examples 7 to 9 were produced as described for example 1 except that the amounts of DER684-EK40 (tradename) and DESMODUR N75 (tradename) were adjusted to obtain various theoretical degrees of hardening, as indicated in Table 2. The weight percentages of DER684-EK40 (tradename) and DESMODUR N75 (tradename) calculated on the basis of the solids contents of the reactants are given in Table 2 together with the CTL layer thicknesses.

The electro-optical properties of the thus obtained photoconductive recording materials were determined as described above and the results are summarized in Table 2 together with those for the photoconductive recording material of example 1.

TABLE 2

| Example No. | DER684-EK40 conc. [wt %] | DESMODUR N75 conc. [wt %] | Theoretical degree of hardening [%] | $^{d}$CTL [μm] | $I_{660}t = 20$ mJ/m$^2$ CL [V] | RP [V] | % discharge |
|---|---|---|---|---|---|---|---|
| 7 | 25.35 | 24.65 | 150 | 9.1 | +536 | +121 | 77.4 |
| 1 | 30.35 | 19.65 | 100 | 13.1 | +550 | +111 | 79.8 |
| 8 | 33.65 | 16.35 | 75 | 14.1 | +551 | +109 | 80.2 |
| 9 | 37.75 | 12.25 | 50 | 13.1 | +559 | +156 | 72.1 |

EXAMPLES 10 TO 17

The photoconductive recording materials of examples 10 to 17 were produced as described for example 1 except that alternative bisphenol A-epichlorhydrin epoxy resins or phenoxy resins were used instead of DER684-EK40 (tradename) and other CTM's were used than N2 as indicated in Table 3. The amounts of epoxy resin/phenoxy resin and DESMODUR N75 (tradename) were adjusted to obtain a theoretical degree of hardening of 100%. The weight percentages of epoxy resin/phenoxy resin and DESMODUR N75 (tradename) calculated on the basis of the solids contents of the reactants are given in Table 3 together with the CTL layer thicknesses.

The electro-optical properties of the thus obtained photoconductive recording materials were determined as described above and the results are summarized in Table 3.

TABLE 3

| Example No. | Resin | Resin conc. [wt %] | Desmodur N75 conc. [wt %] | CTM | $^{d}$CTL [μm] | $I_{660}t = 20$ mJ/m$^2$ CL [V] | RP [V] | % discharge |
|---|---|---|---|---|---|---|---|---|
| 10 | DER684-EK40 | 30.35 | 19.65 | N3 | 12.1 | +552 | +88 | 84.0 |
| 11 | PHENOXY PKHC* | 29.88 | 20.12 | N3 | 13.1 | +568 | +140 | 75.4 |
| 12 | PHENOXY PKHH* | 29.5 | 20.5 | N3 | 12.1 | +564 | +142 | 74.8 |
| 13 | PRENOXY PKHJ* | 29.88 | 20.12 | N3 | 11.1 | +564 | +106 | 81.2 |
| 14 | PHENOXY PKHM-301* | 32.5 | 17.5 | N3 | 12.1 | +573 | +169 | 70.5 |
| 15 | ARALDITE GZ488 N40° | 28.35 | 21.65 | N2 | 15.1 | +568 | +145 | 74.5 |
| 16 | ARALDITE GT7203° | 38.3 | 11.7 | N2 | 15.1 | +561 | +102 | 81.8 |
| 17 | EPONOL Resin 53-BH-35 | 29.63 | 20.37 | N2 | 12.1 | +538 | +96 | 82.2 |
| 18 | EPONOL Resin 55-BH-30 | 29.63 | 20.37 | N2 | 12.1 | +526 | +98 | 81.4 |

*from Union Carbide
°from Ciba-Geigy AG.
The EPONOL Resins are from Shell Chemicals Co.

EXAMPLES 19 TO 23

The photoconductive recording materials of examples 19 to 23 were produced as described for example 1 except that alternative CTM's were used instead of N2. The CTL layer thicknesses are given in Table 4 together with the CTM concentrations used.

The electro-optical properties of the thus obtained photoconductive recording materials were determined as described above and the results are summarized in Table 4 together with those for the photoconductive recording materials of exhales 1 and 10.

TABLE 4

| Example No. | CTM | CTM-conc. [wt %] | $d^{CTL}$ [μm] | $I_{780}t = 20$ mJ/m$^2$ CL [V] | RP [V] | % discharge |
|---|---|---|---|---|---|---|
| 19 | N1 | 45 | 15.1 | +547 | +97 | 82.3 |
| 1 | N2 | 45 | 13.1 | +550 | +111 | 79.8 |
| 10 | N3 | 45 | 12.1 | +552 | +88 | 84.0 |
| 20 | N4 | 44.4 | 14.1 | +511 | +61 | 88.1 |
| 21 | N6 | 50 | 12.1 | +433 | +138 | 68.1 |
| 22 | N7 | 50 | 13.1 | +447 | +185 | 58.6 |
| 23 | N8 | 50 | 15.1 | +485 | +217 | 55.3 |

In the composition of Example 20 11.1% by weight of TPD as defined hereinbefore was used.

EXAMPLES 24 TO 29

The photoconductive recording materials of examples 24 to 29 were produced as described for example 1 except that different CGM's were used and different mixing times. The CTL layer thicknesses are given in Table 5.

The electro-optical properties of the thus obtained photoconductive recording materials were determined as described above and the results are summarized in Table 5 together with those for the photoconductive recording material of example 1.

TABLE 5

| Example No. | CGM | Grinding time [h] | $^{d}$CTL [μm] | λ [nm] | It = 20 mJ/m$^2$ CL [V] | RP [V] | % Discharge |
|---|---|---|---|---|---|---|---|
| 1 | FASTOGEN BLUE 8120B | 40 | 13.1 | 660 | +550 | +111 | 79.8 |
| 24 | X-$H_2$Pc $(CN)_{0.36}$ | 40 | 14.1 | 660 | +503 | +116 | 76.9 |
| 25 | W-$H_2$TTP | 72 | 14.1 | 660 | +549 | +222 | 59.6 |
| 26 | X-$H_2$Pc($CH_3$) | 40 | 12.1 | 660 | +552 | +202 | 63.4 |
| 27 | X-$H_2$PcCl$_{0.67}$ | 40 | 12.1 | 660 | +545 | +187 | 65.7 |
| 28 | DEA | 40 | 14.1 | 540 | +501 | +263 | 47.5 |
| 29 | PERYLENE PIGMENT | 40 | 15.1 | 540 | +155 | +99 | 36.1 |

EXAMPLES 30 AND 31

The photoconductive recording materials of examples 30 and 31 were produced as described for example 1 except that dialkanolamine-modified epoxy resins were used instead of DER684-EK40 (tradename). The amounts of the dialkanolamine-modified epoxy resins and DESMODUR N75 (tradename) were adjusted to obtain a theoretical degree of hardening of 100%. The weight percentages of dialkanolamine-modified epoxy resins and DESMODUR N75 (tradename) calculated on the basis of the solids contents of the reactants are given in Table 6 together with the CTL layer thicknesses.

The electro-optical properties of the thus obtained photoconductive recording materials were determined as described above and the results are summarized in Table 6.

TABLE 6

| Example No. | Resin | Resin conc. [wt %] | DESMODUR N75 conc. [wt %] | $^{d}$CTL [μm] | $I_{660}t$ = 20 mJ/m$^2$ CL [V] | RP [V] | % discharge |
|---|---|---|---|---|---|---|---|
| 30 | Diethanolamine-modified ARALDITE GT6071 | 17.73 | 32.27 | 12.1 | +558 | +128 | 77.1 |
| 31 | Diethanolamine-modified ARALDITE GT6099 | 23.32 | 26.68 | 17.1 | +564 | +130 | 77.0 |

We claim:

1. A photoconductive recording material containing a support and a charge generating layer (CGL) in contiguous relationship with a charge transporting layer (CTL) containing a n-charge transporting material (n-CTM), wherein the binder of said charge generating layer (CGL) is made insoluble in methylene chloride by crosslinking, and said binder is composed essentially of resins (1) and/or (2) crosslinked with at least one polyisocyanate, said resin (1) before its crosslinking corresponding with the following general formula (I):

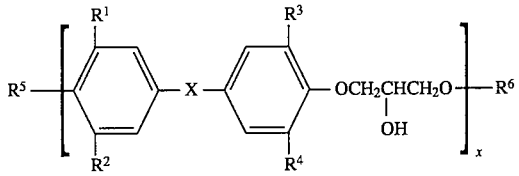

(I)

in which: X represent S, $SO_2$,

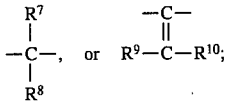

each of $R^1$, $R^2$, $R^3$, $R^4$, $R^9$ and $R^{10}$ (same or different) represents hydrogen, halogen, an alkyl group or an aryl group; where $R^5$=OH,

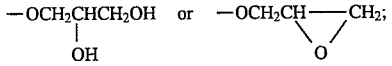

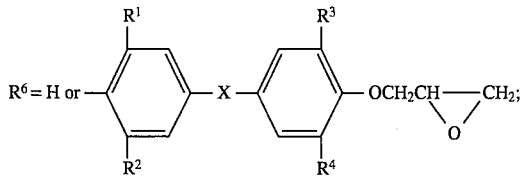

each of $R^7$ and $R^8$ (same or different) represents hydrogen, an alkyl group, an aryl group or together represent the necessary atoms to close a cycloaliphatic ring; and $x \geqq 4$; and said resin (2) before its crossklinking being an epoxy resin that has undergone a reaction with a dialkanolamine.

2. Photoconductive recording material according to claim 1, wherein said charge generating layer contains as the sole binder one or more resins obtained by the crosslinking with one or more polyisocyanates of at least one polymeric compound according to said general formula (I) and/or of at least one epoxy resin that has undergone a reaction with a dialkanolamine.

3. Photoconductive recording material according to claim 1, wherein said charge generating layer contains one or more resins obtained by the crosslinking of polymeric compounds according to said general formula (I) and/or at of least one epoxy resin that has undergone a reaction with a dialkanolamine having free HO-groups in a total amount in an equivalent ratio range from 1:8.1 to 1:1.8 with respect to free isocyanate groups of said polyisocyanate(s).

4. Photoconductive recording material according to claim 1, wherein said charge generating layer contains (i) one or more resins obtained by the crosslinking of polymeric compounds according to said general formula (I) and/or of at least one epoxy resin that has undergone a reaction with a dialkanolamine with one or more polyisocyanates and (ii) at least 30 wt % of charge generating compounds(s).

5. Photoconductive recording material according to claim 1, wherein said polyisocyanate compounds serving as crosslinking agents in the formation of a polyurethane resin with at least one of said resins (1) and/or resins (2) are selected from the group consisting of 1,6-hexane diisocyanate, toluylene diisocyanate, 1,4-cyclohexane diisocyanate and 4,4'-diisocyanate-dicyclohexylmethane.

6. Photoconductive recording material according to claim 1, wherein the polyisocyanate used in the crosslinking reaction is set free in situ in the recording layer from a blocked polyisocyanate.

7. Photoconductive recording material according to any of the preceding claims, wherein said resins obtained by crosslinking the resins according to said general formula (I) and an epoxy resin that has undergone a reaction with a dialkanolamine with polyisocyanates are used in combination with at least one other polymer serving as binding agent.

8. Photoconductive recording material according to claim 7, wherein said other polymer is 'selected from the group consisting of an acrylate resin, methacrylate resin, copolyester of a diol with isophthalic and/or terephthalic acid, polyacetal, polyurethane, polyester-urethane and aromatic polycarbonate.

9. Photoconductive recording material according to claim 7 or 8, wherein said other polymer is present in said combination in an amount less than 50% by weight of the total binder content.

10. Photoconductive recording material according to any of the preceding claims, wherein said support consists of aluminium or is a support provided with an aluminium layer forming a conductive coating.

* * * * *